US007604518B2

(12) United States Patent
Diemer et al.

(10) Patent No.: US 7,604,518 B2
(45) Date of Patent: Oct. 20, 2009

(54) ELECTRICAL CONTACT WITH RETENTION LATCH

(75) Inventors: Donald Alan Diemer, Oak Ridge, NC (US); Donald Michael Baughn, Burlington, NC (US)

(73) Assignee: Tyco Electronics Corporation, Middletown, PA (US)

( * ) Notice: Subject to any disclaimer, the term of this patent is extended or adjusted under 35 U.S.C. 154(b) by 10 days.

(21) Appl. No.: 11/945,013

(22) Filed: Nov. 26, 2007

(65) Prior Publication Data

US 2009/0137161 A1 May 28, 2009

(51) Int. Cl.
*H01R 13/40* (2006.01)

(52) U.S. Cl. ..... 439/733.1; 439/444

(58) Field of Classification Search ..... 439/444, 439/733.1, 884, 885

See application file for complete search history.

(56) References Cited

U.S. PATENT DOCUMENTS 4,410,230 A * 10/1983 SanMiguel ..... 439/682
5,071,372 A * 12/1991 Viselli et al. ..... 439/733.1
5,256,073 A * 10/1993 Reymond et al. ..... 439/79

* cited by examiner

*Primary Examiner*—Khiem Nguyen

(57) ABSTRACT

An electrical contact for use with electronic devices is provided. This electrical contact includes a mating portion; a wire retaining portion; and body portion formed integrally with the wire retaining portion. The body portion further includes a central axis running lengthwise therethrough and at least one outwardly biased retention member, wherein the retention member is formed from the same material as the body portion and is integral therewith, and wherein the angle of deflection of the retention member is substantially perpendicular to the central axis of the body.

17 Claims, 3 Drawing Sheets

ELECTRICAL CONTACT WITH RETENTION LATCH

BACKGROUND OF THE INVENTION

The described invention relates in general to connector systems for use with electronic equipment, and more specifically to connector systems that utilize pin and socket type contacts (i.e., terminals) such as those typically found in MATE-N-LOK systems or comparable systems.

"Molex connector" is a common term used for a two-piece "pin and socket" type interconnection that is frequently used for disk drive connectors and other devices. Pioneered by Molex Products Company, the two-piece design became an early standard in the electronics industry. First used in home appliances, other industries soon began to incorporate these connectors into products ranging from automobiles to vending machines to mini-computers. These connectors include cylindrical spring-metal pin contacts that fit into cylindrical spring-metal socket contacts. The pins and sockets are usually configured in a rectangular matrix, which is held in a nylon shell or other type of shell, and an individual connector typically includes 2, 3, 4, 5, 6, 9, 12, or 15 pin and socket pairs, each representing a different electronic circuit. Pins and sockets can be arranged in various possible combinations within a single connector and the housing is typically separated into male and female portions. AMP (now a division of Tyco Electronics) developed the MATE-N-LOK 0.084 pin connector, which was initially used on disk drives. This interconnection configuration is now the established standard for disk drive power connectors.

Despite its widespread adoption, the MATE-N-LOK connector system has certain shortcomings. For example, when in use, the pin and socket contacts may experience inconsistent retention within the housing portions of the connector system. Inconsistent retention within the housing may lead to partial or total failure of the connector and consequently to diminished performance or even failure of the device into which the connector is incorporated. Thus, there is an ongoing need for pin and socket contacts that provide more consistent and reliable retention within the housing of the connector.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a connector system for use with electronic devices is provided. This connector system includes a first electrical contact and a second electrical contact for use with the first electrical contact. The first electrical contact further includes a pin; a body formed integrally with the pin and having a central axis running lengthwise therethrough; and at least one outwardly biased retention member. The retention member is formed from the same material as the body and is integral therewith, and the angle of deflection (i.e., biasing action) of the retention member is substantially perpendicular to the central axis of the body. The second electrical contact further includes a socket adapted to receive the pin; a body formed integrally with the socket and having a central axis running lengthwise therethrough; and at least one outwardly biased retention member. The retention member is formed from the same material as the body and is integral therewith, and the angle of deflection (i.e., biasing action) of the retention member is substantially perpendicular to the central axis of the body.

In accordance with another aspect of the present invention, an electrical contact for use with electronic devices is provided. This electrical contact includes a body having a central axis running lengthwise therethrough and at least one outwardly biased retention member. The retention member is formed from the same material as the body and is integral therewith. The biasing action and angle of deflection of the retention member is substantially perpendicular to the central axis of the body.

In yet another aspect of this invention, an electrical contact for use with electronic devices is provided. This electrical contact includes a mating portion; a wire retaining portion; and body portion formed integrally with the wire retaining portion. The body portion further includes a central axis running lengthwise therethrough and at least one outwardly biased retention member, wherein the retention member is formed from the same material as the body portion and is integral therewith, and wherein the angle of deflection of the retention member is substantially perpendicular to the central axis of the body.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1A:
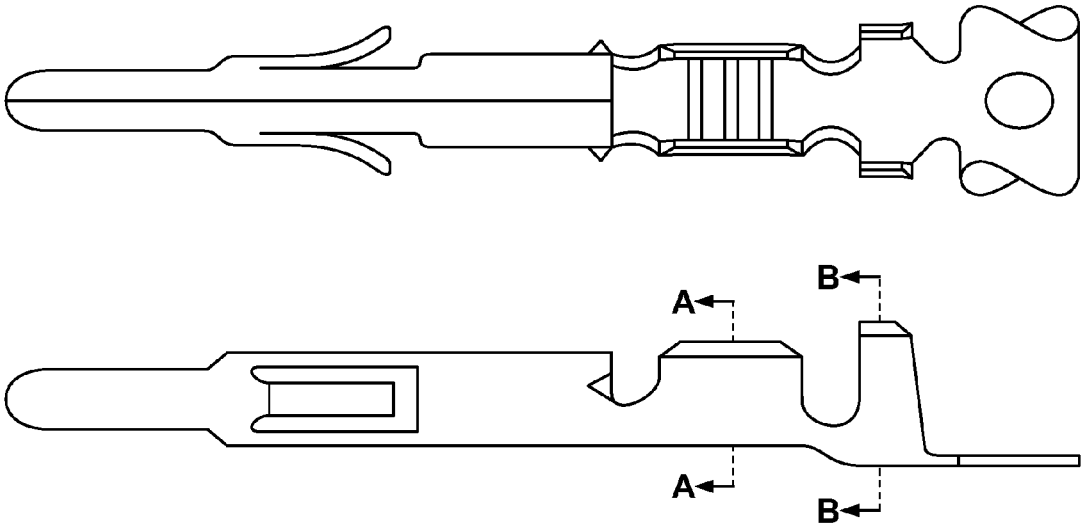
FIG. 1A (Prior Art)
FIGS. 1A-B provide top and side views of a prior art pin connector and a prior socket connector respectively showing the placement and parallel orientation of the retention members formed thereon.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to systems and devices used in electronic equipment including computers and the like. As previously indicated, a first general embodiment of this invention provides a connector system for use with electronic devices; a second general embodiment of this invention provides an electrical contact for use with electronic devices; and a third general embodiment of this invention also provides an electrical contact for use with electronic devices. With reference now to the Figures, one or more specific embodiments of this invention shall be described in greater detail.

Figure 1B:
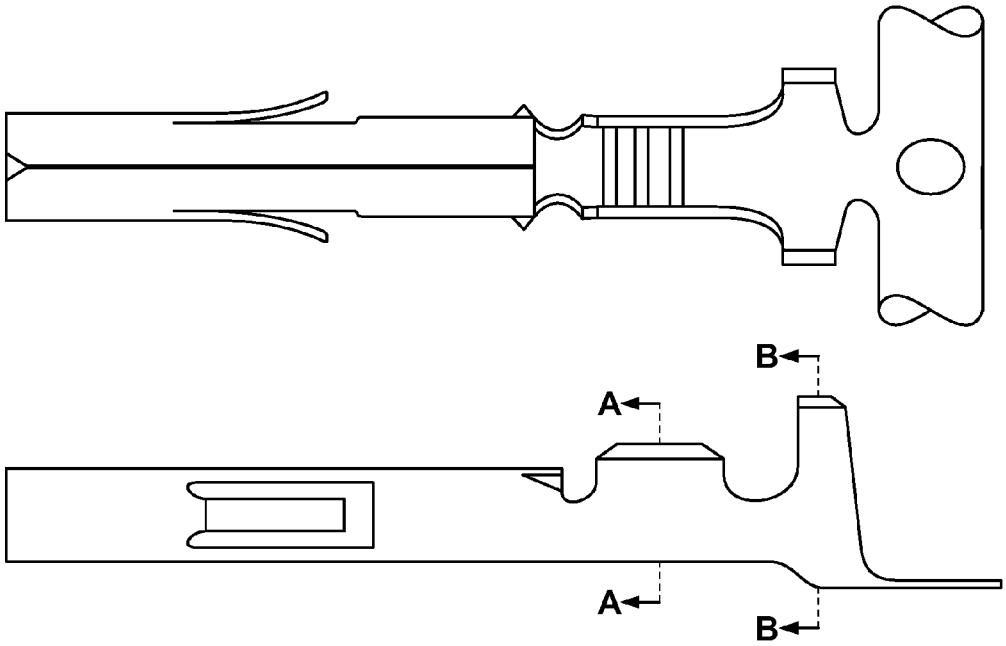
FIG. 1B (Prior Art)
Figure 2A:
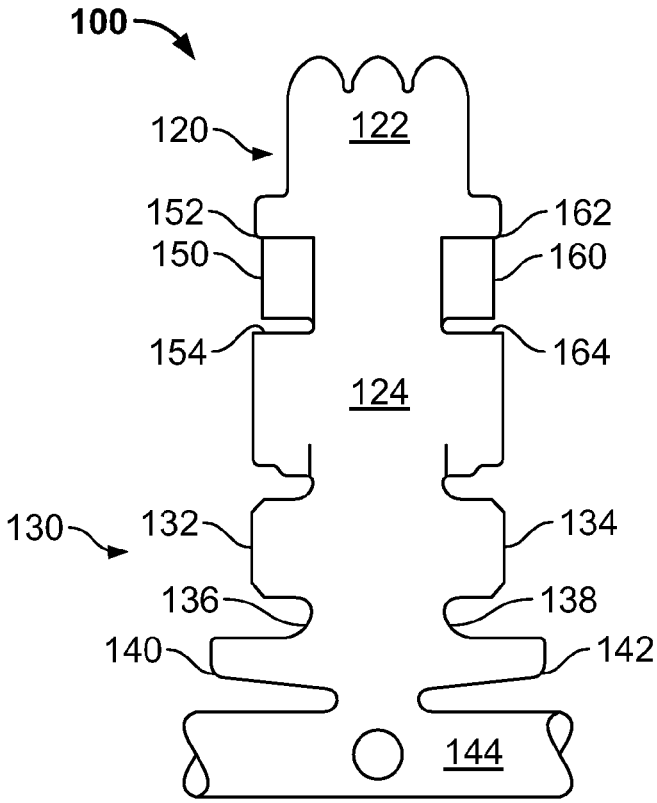
FIG. 2A is a top view of a first exemplary embodiment of the contact of the present invention shown in a pre-rolled flattened state.
Figure 2B:
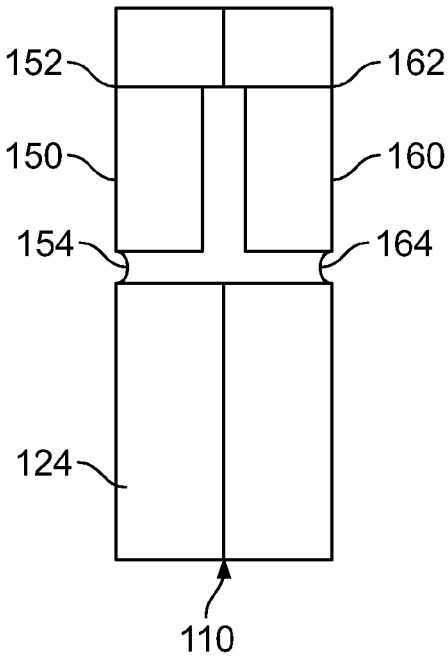
FIGS. 2B-C are top and side views respectively of a portion of the contact of FIG. 2A showing the placement and orientation of the retention members formed thereon after the contact has been rolled into its final configuration.
Figure 2C:
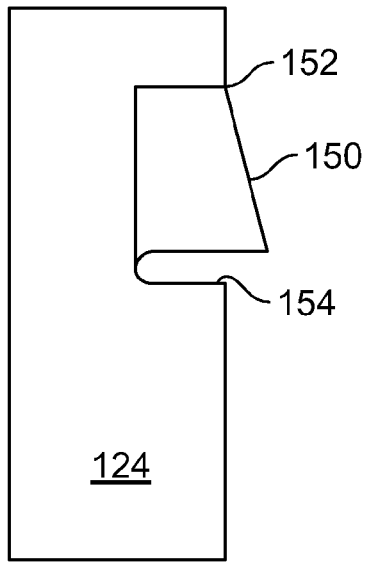

With reference now to the Figures, FIGS. 1A-B provide several views of prior art pin and socket contacts that do not include certain novel features of this invention and FIGS. 2A-C and 3A-C provide various illustrative views of exemplary electrical contacts in accordance with the present invention. As shown in FIGS. 2A-C, pin contact 100, which is shown in a flattened state prior to being rolled into a final configuration, includes a mating portion 120, an elongated body 124, and a wire retaining portion 130. In this embodiment, socket mating portion 120 includes a rounded tip 122, which is adapted to be inserted into a corresponding MATE-N-LOK socket as part of a standard MATE-N-LOK system or similar pin-and-socket mating system. Wire retaining portion 130 is adapted to receive a length of partially stripped wire and includes a wire barrel, a locator slot, and an insulation barrel. The wire barrel includes first and second tabs 132 and 134, the locator slot includes first and second notches 136 and 138, and the insulation barrel includes first and second tabs 140 and 142. In use, tabs 132 and 134 are crimped around the stripped portion of the wire and tabs 140 and 142 are crimped around the insulated portion of the same wire. Pin contact 100 is typically manufactured on a carrier strip with other pin contacts. A portion 144 of this carrier strip is shown in FIG. 2A.

As best shown in FIGS. 2B-C, first and second outwardly biased retention members 150 and 160, which may also be referred to as "latches", are formed on either side of body 124 near tip 122. Retention members 150 and 160 are formed integrally with body 124 and from the same material as body 124. In this embodiment, shear lines 152 and 162 are formed between body 124 and retention members 150 and 160 respectively, as are profiles 154 and 164. When contact 100 is rolled into its final configuration (see FIGS. 2B-2C), retention members 150 and 160 are oriented such that the biasing action, i.e., angle of deflection, of each retention member is substantially perpendicular, rather than parallel (see FIGS. 1A-B), to the central axis of body 124 and of contact 100 in general. Additionally, the outer edge of each retention member is angled such that the rear edge thereof is a greater distance from body 124 than is the front edge of the retention member. In the embodiment shown in the Figures the rear edge of each retention member is about 0.020 inches (0.051 cm) out from body 124. Other dimensions and shapes are possible.

Figure 3A:
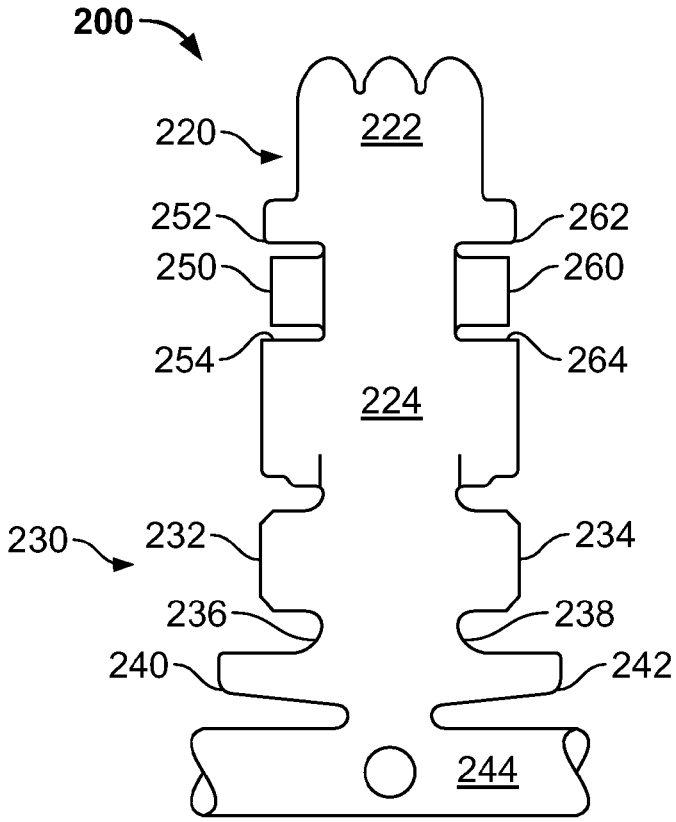
FIG. 3A is a top view of a second embodiment of the contact of the present invention shown in a pre-rolled flattened state.
Figure 3B:
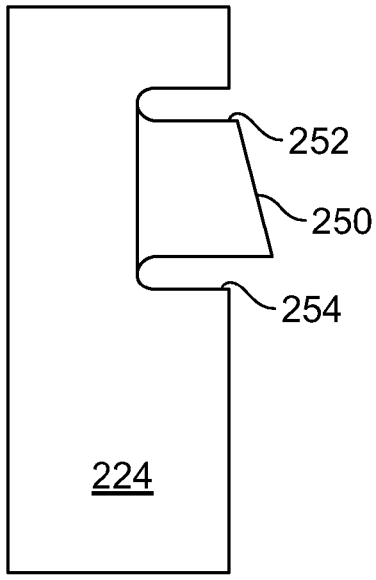
FIGS. 3B-C are top and side views respectively of a portion of the contact of FIG. 3A showing the placement and orientation of the retention members formed thereon after the contact has been rolled into its final configuration.
Figure 3C:
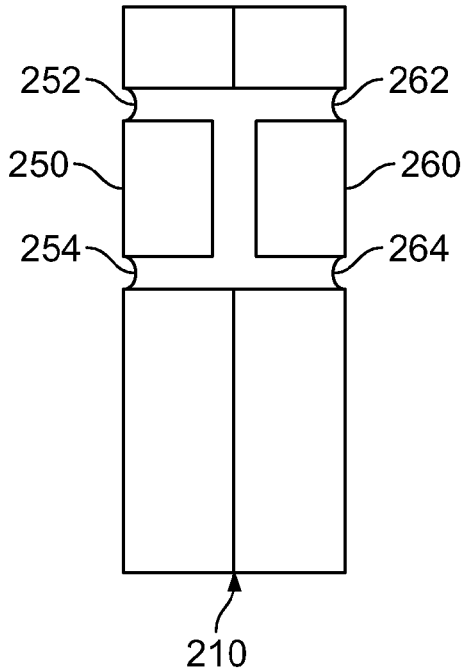

As shown in FIGS. 3A-C, pin contact 200, which is shown in a flattened state prior being rolled into a final configuration, includes a mating portion 220, an elongated body 224, and a wire retaining portion 230. In this embodiment, socket mating portion 220 includes a rounded tip 222, which is adapted to be inserted into a corresponding MATE-N-LOK socket as part of a standard MATE-N-LOK system or similar pin-and-socket mating system. Wire retaining portion 230 is adapted to receive a length of partially stripped wire and includes a wire barrel, a locator slot, and an insulation barrel. The wire barrel includes first and second tabs 232 and 234, the locator slot includes first and second notches 236 and 238, and the insulation barrel includes first and second tabs 240 and 242. In use, tabs 232 and 234 are crimped around the stripped portion of the wire and tabs 240 and 242 are crimped around the insulated portion of the same wire. Pin contact 200 is typically manufactured on a carrier strip with other pin contacts. A portion 244 of this carrier strip is shown in FIG. 3A.

As best shown in FIGS. 3B-C, first and second outwardly biased retention members or latches 250 and 260, are formed on either side of body 224 near tip 222. Retention members 250 and 260 are formed integrally with body 224 and from the same material as body 224. In this embodiment, profiles 252 and 262 are formed between body 224 and retention members 250 and 260 respectively, as are profiles 254 and 264. When contact 200 is rolled into its final configuration (see FIGS. 3B-C), retention members 250 and 260 are oriented such that the biasing action, i.e., angle of deflection, of each retention member is substantially perpendicular, rather than parallel (see FIGS. 1A-B), to the central axis of body 224 and of contact 200 in general. Additionally, the outer edge of each retention member is angled such that the rear edge thereof is a greater distance from body 224 than is the front edge of the retention member. In the embodiment shown in the Figures the rear edge of each retention member is about 0.020 inches (0.051 cm) out from body 224. Other dimensions and shapes are possible.

As previously indicated, the contacts of the present invention are intended for use with connector systems included in electronic devices and are typically manufactured from electrically conductive metal using known manufacturing techniques and methods (e.g., form tooling). Connector systems of this nature typically include a connector assembly that further includes multiple housing components. In some connector systems, these housing components are referred to as plug housings and cap housings (not shown in the Figures). Each housing component typically includes at least one elongated cavity formed therein for receiving either a pin contact or a socket contact. When a pin or socket contact is inserted into a cavity (from the rear side of the housing portion), the "spring-loaded" retention members formed on the body portions of the contacts engage the inner surface of the contact cavity and securely retain the contact therein. As previously discussed, the biasing action, i.e., angle of deflection, of the retention members of the present invention are oriented substantially perpendicular to the central axis of the contact. This orientation/configuration creates additional surface area along the top edge of each retention member compared to prior art designs. This additional surface area, in combination with the angled design of each retention member, increases the amount of force required to pull a contact from the housing component into which it has been inserted. Consequently, the electrical contacts of the present invention are much more difficult to inadvertently remove from a housing component and thus experience greater and more consistent retention therein. The retention members as described herein may be formed on either pin contacts or socket contacts, or both, and may be present on each contact as a single structure or multiple structures.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A connector system for use with electronic devices, comprising:

(a) a first electrical contact, wherein the first electrical contact further includes:

(i) a pin;

(ii) a body formed integrally with the pin, wherein the pin and body further include a central axis running lengthwise therethrough; and (iii) at least one outwardly biased retention member, wherein the retention member is formed from the same material as the body and is integral therewith and further includes an angled contact surface formed at one end thereof, and wherein the angle of deflection of the retention member is substantially perpendicular to the central axis of the pin and body;

(b) a second electrical contact, wherein the second electrical contact further includes:

(i) a socket adapted to receive the pin;

(ii) a body formed integrally with the socket, wherein the socket and body further include a central axis running lengthwise therethrough; and (iii) at least one outwardly biased retention member, wherein the retention member is formed from the same material as the body and is integral therewith and further includes an angled contact surface formed at one end thereof, and wherein the angle of deflection of the retention member is substantially perpendicular to the central axis of the socket and body; and (c) wherein the angled contact surfaces formed at the end of the retention members and the angle of deflection of the contact members are operative to increase the amount of force required to remove the pin from the socket when the first electrical contact is inserted into the second electrical contact.

2. The connector system of claim 1, wherein the body of the first electrical contact further comprises a wire retaining portion adapted to receive electrical wires.

3. The connector system of claim 2, wherein the wire retaining portion further comprises a crimpable wire barrel, a locator slot, and a crimpable insulation barrel.

4. The connector system of claim 1, wherein the body of the second electrical contact further comprises a wire retaining portion adapted to receive electrical wires.

5. The connector system of claim 4, wherein the wire retaining portion further comprises a crimpable wire barrel, a locator slot, and a crimpable insulation barrel.

6. The connector system of claim 1, wherein each electrical contact is fabricated by form tooling.

7. An electrical contact for use with electronic devices, comprising:

(a) a body having a central axis running lengthwise therethrough; and (b) at least one outwardly biased retention member, wherein the retention member is formed from the same material as the body and is integral therewith and further includes an angled contact surface formed at one end thereof, and wherein the angle of deflection of the retention member is substantially perpendicular to the central axis of the body.

8. The electrical contact of claim 7, further comprising a mating portion formed integrally with the body, wherein the mating portion further includes a pin.

9. The electrical contact of claim 7, further comprising a mating portion formed integrally with the body, wherein the mating portion further includes a socket.

10. The electrical contact of claim 7, wherein the contact is stamped from a single piece of material, and wherein the material is electrically conductive metal.

11. The electrical contact of claim 7, wherein the contact is fabricated by form tooling.

12. An electrical contact for use with electronic devices, comprising:

(a) a mating portion;

(b) a wire retaining portion; and (c) a body portion formed integrally with the wire retaining portion, wherein the body portion further includes:

(i) a central axis running lengthwise therethrough; and (ii) at least one outwardly biased retention member, wherein the retention member is formed from the same material as the body portion and is integral therewith and further includes an angled contact surface formed at one end thereof, and wherein the angle of deflection of the retention member is substantially perpendicular to the central axis of the body.

13. The electrical contact of claim 12, wherein the mating portion further comprises a pin.

14. The electrical contact of claim 12, wherein the mating portion further comprises a socket.

15. The electrical contact of claim 12, wherein the wire retaining portion of the contact further comprises a crimpable wire barrel, a locator slot, and a crimpable insulation barrel.

16. The electrical contact of claim 12, wherein the contact is stamped from a single piece of material, and wherein the material is electrically conductive metal.

17. The electrical contact of claim 12, wherein the contact is fabricated by form tooling.

* * * * *